US008398458B2

(12) United States Patent
Yilmaz

(10) Patent No.: US 8,398,458 B2
(45) Date of Patent: Mar. 19, 2013

(54) MODULAR BASE-PLATE SEMICONDUCTOR POLISHER ARCHITECTURE

(75) Inventor: Alpay Yilmaz, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 878 days.

(21) Appl. No.: 12/490,928

(22) Filed: Jun. 24, 2009

(65) Prior Publication Data

US 2010/0003902 A1 Jan. 7, 2010

Related U.S. Application Data

(60) Provisional application No. 61/077,303, filed on Jul. 1, 2008.

(51) Int. Cl.
*B24B 49/00* (2006.01)

(52) U.S. Cl. ..... 451/11; 451/285; 451/287; 451/336

(58) Field of Classification Search ..... 451/11, 451/41, 285, 287, 288, 289, 290, 336, 398, 451/402

See application file for complete search history.

(56) References Cited

U.S. PATENT DOCUMENTS

| | | | | |
|---|---|---|---|---|
| 5,616,063 | A * | 4/1997 | Okumura et al. | 451/1 |
| 6,283,701 | B1 * | 9/2001 | Sundar et al. | 414/744.5 |
| 6,309,279 | B1 * | 10/2001 | Bowman et al. | 451/41 |
| 6,685,422 | B2 * | 2/2004 | Sundar et al. | 414/744.5 |
| 6,801,326 | B2 * | 10/2004 | Finarov et al. | 356/630 |
| 6,818,066 | B2 * | 11/2004 | Cheung | 118/715 |
| 6,872,329 | B2 | 3/2005 | Wang et al. | |
| 6,919,653 | B2 | 7/2005 | Thirunarayan et al. | |
| 6,919,654 | B2 | 7/2005 | Harned et al. | |
| 7,238,087 | B1 * | 7/2007 | Kashiwa et al. | 451/41 |
| 7,241,203 | B1 * | 7/2007 | Chen et al. | 451/11 |
| 2001/0000586 | A1 | 5/2001 | Li et al. | |
| 2002/0031985 | A1 | 3/2002 | Wang et al. | |
| 2007/0247008 | A1 | 10/2007 | Miyamoto | |
| 2007/0278863 | A1 | 12/2007 | Yamamoto et al. | |
| 2008/0239308 | A1 * | 10/2008 | Ravid et al. | 356/302 |
| 2009/0318060 | A1 * | 12/2009 | Dhandapani et al. | 451/5 |
| 2010/0330878 | A1 * | 12/2010 | Kobayashi et al. | 451/5 |

FOREIGN PATENT DOCUMENTS

| | | |
|---|---|---|
| CN | 101112749 | 1/2008 |
| KR | 20040110511 | 12/2004 |
| KR | 20070077979 | 7/2007 |
| WO | WO-94/04404 | 3/1994 |

OTHER PUBLICATIONS

PCT International Search Report and Written Opinion dated Feb. 17, 2010 for International Application No. PCT/US2009/047689.
First Office Action dated Jul. 18, 2012 for Chinese Patent Application No. 200980125897.8.

* cited by examiner

*Primary Examiner* — Eileen P. Morgan
(74) *Attorney, Agent, or Firm* — Patterson & Sheridan, LLP

(57) ABSTRACT

The present invention generally relates to a polishing system. Particularly, the present invention relates a polishing apparatus having one or more modular polishing stations, and a plurality of polishing heads movably connected to a transferring system.

15 Claims, 6 Drawing Sheets

MODULAR BASE-PLATE SEMICONDUCTOR POLISHER ARCHITECTURE

CROSS-REFERENCE TO RELATED APPLICATIONS

This application claims benefit of U.S. provisional patent application Ser. No. 61/077,303, filed Jul. 1, 2008, which is herein incorporated by reference.

BACKGROUND OF THE INVENTION

1. Field of the Invention

Embodiments of the present invention generally relate to an apparatus and a method for processing semiconductor substrates. More particularly, embodiments of the present invention provide apparatus and method for polishing semiconductor substrates.

2. Description of the Related Art

Sub-micron multi-level metallization is one of the key technologies for the next generation of ultra large-scale integration (ULSI). The multilevel interconnects that lie at the heart of this technology require planarization of interconnect features formed in high aspect ratio apertures, including contacts, vias, trenches and other features. Reliable formation of these interconnect features is very important to the success of ULSI and to the continued effort to increase circuit density and quality on individual substrates and die.

In the fabrication of integrated circuits and other electronic devices, multiple layers of conductive, semi-conductive, and dielectric materials are deposited on or removed from a surface of a substrate. Thin layers of conductive, semiconductive, and dielectric materials may be deposited by a number of deposition techniques. As layers of materials are sequentially deposited and removed, the uppermost surface of the substrate may become non-planar across its surface and require planarization.

Planarization is generally performed using Chemical Mechanical Polishing (CMP) and/or Electro-Chemical Mechanical Deposition (ECMP). A planarization method typically requires that the substrate be mounted in a wafer head, with the surface of the substrate to be polished exposed. The substrate supported by the head is then placed against a rotating polishing pad. The head holding the substrate may also rotate, to provide additional motion between the substrate and the polishing pad surface. Further, a polishing slurry (typically including an abrasive and at least one chemically reactive agent therein, which are selected to enhance the polishing of the topmost film layer of the substrate) is supplied to the pad to provide an abrasive chemical solution at the interface between the pad and the substrate. The combination of polishing pad characteristics, the specific slurry mixture, and other polishing parameters can provide specific polishing characteristics.

Polishing is generally performed in multiple steps at three or less polishing stations, each having specific polishing characteristics, to achieve desired results. Therefore, a polishing system generally has two or three polishing stations each configured to perform a specific polishing step. Conventional polishing systems generally have one mainframe on which the two or three polishing stations and at least one load cup are disposed. Conventional polishing systems also have multiple polishing heads movably positioned on the mainframe. The conventional polishing systems have limited flexibility in polishing station configuration to meet different process requirements or to adapt changes.

Therefore, there is a need for a polishing apparatus which provides flexibility in system configuration to meet various process requirements.

SUMMARY OF THE INVENTION

The present invention generally relates to a polishing system. Particularly, the present invention relates a polishing apparatus having one or more modular polishing stations.

One embodiment of the present invention provides a semiconductor substrate polishing system comprising a frame defining a processing volume, a plurality of polishing heads movably disposed in the processing volume, wherein each of the plurality of polishing heads is configured to retain and transfer a substrate during processing, a transferring mechanism coupled to the frame, wherein the transferring mechanism is configured to move the plurality of polishing heads in the processing volume, and two or more stand alone polishing stations disposed in the processing volume, wherein each of the two or more stand alone polishing stations comprises a polishing pad configured to receive and interact with each of the plurality of polishing heads, and the two or more stand alone polishing stations can be rearranged without affecting the transferring mechanism and the plurality of polishing heads.

Another embodiment of the present invention provides a semiconductor substrate polishing system comprising a supporting frame, a track assembly coupled to the supporting frame, one or more polishing heads movably coupled to the track assembly, wherein the track assembly defines a path and the one or more polishing heads are independently movable along the path, and first and second stand alone polishing stations disposed along the path, wherein each of the first and second stand alone polishing stations is configured to receive the one or more polishing heads and to process substrates retained by the one or more polishing heads.

Yet another embodiment of the present invention provides a stand alone polishing station comprising a body, a platen assembly disposed on the body, wherein the polishing pad is disposed on the platen, an interface assembly disposed on the body, wherein the interface assembly is configured to connect the polishing station with a polishing solution source, a power source, and a controller, and a moving mechanism configured to allow easy movement of the polishing station.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments of the present invention generally relate to an apparatus and a method for transferring and supporting a substrate in a chemical mechanical polishing (CMP) system or electrochemical mechanical polishing (ECMP) system. In one embodiment of the present invention, two or more stand alone polishing stations are assembled for completing a polishing process, and a transferring mechanism is used to transfer a plurality of polishing heads independently among the two or more stand alone polishing stations. In one embodiment, the arrangement of the two or more stand alone polishing stations is separated from the transferring system and the plurality of polishing heads. In one embodiment, the stand alone polishing station comprises a moving mechanism allowing easy movement for arrangement, rearrangement, or maintenance of the polishing station. In one embodiment, the moving mechanism of the stand alone polishing station comprises casters. In another embodiment, the stand alone polishing station also comprises a positioning mechanism configured to lock the stand alone polishing station in position during polishing. In one embodiment, a track system is used to transfer one or more polishing heads independently among the two or more stand alone polishing stations. In one embodiment, the track is circular.

Figure 1A:
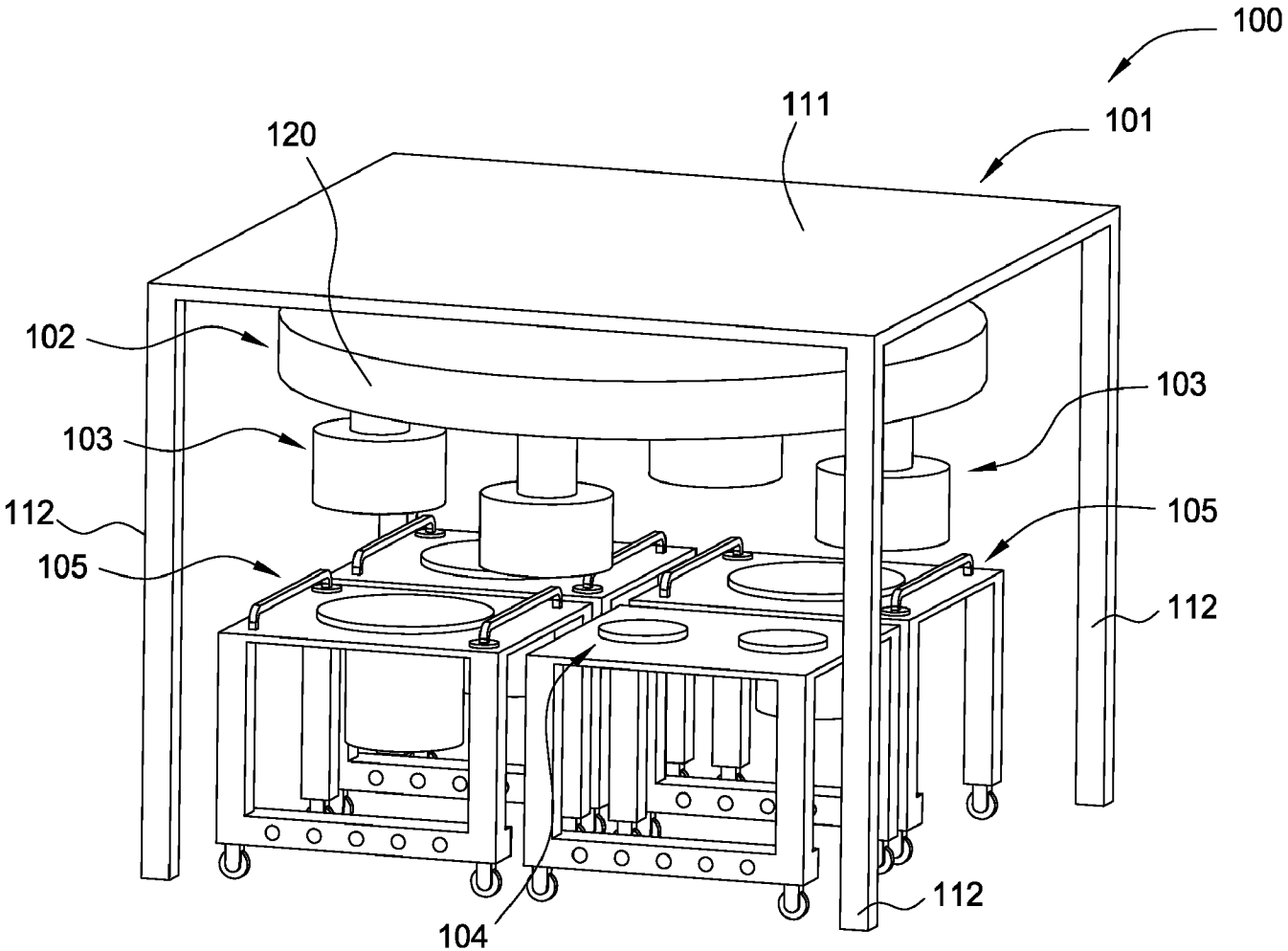
FIG. 1A is a schematic perspective view of a polishing system in accordance with one embodiment of the present invention.
Figure 1B:
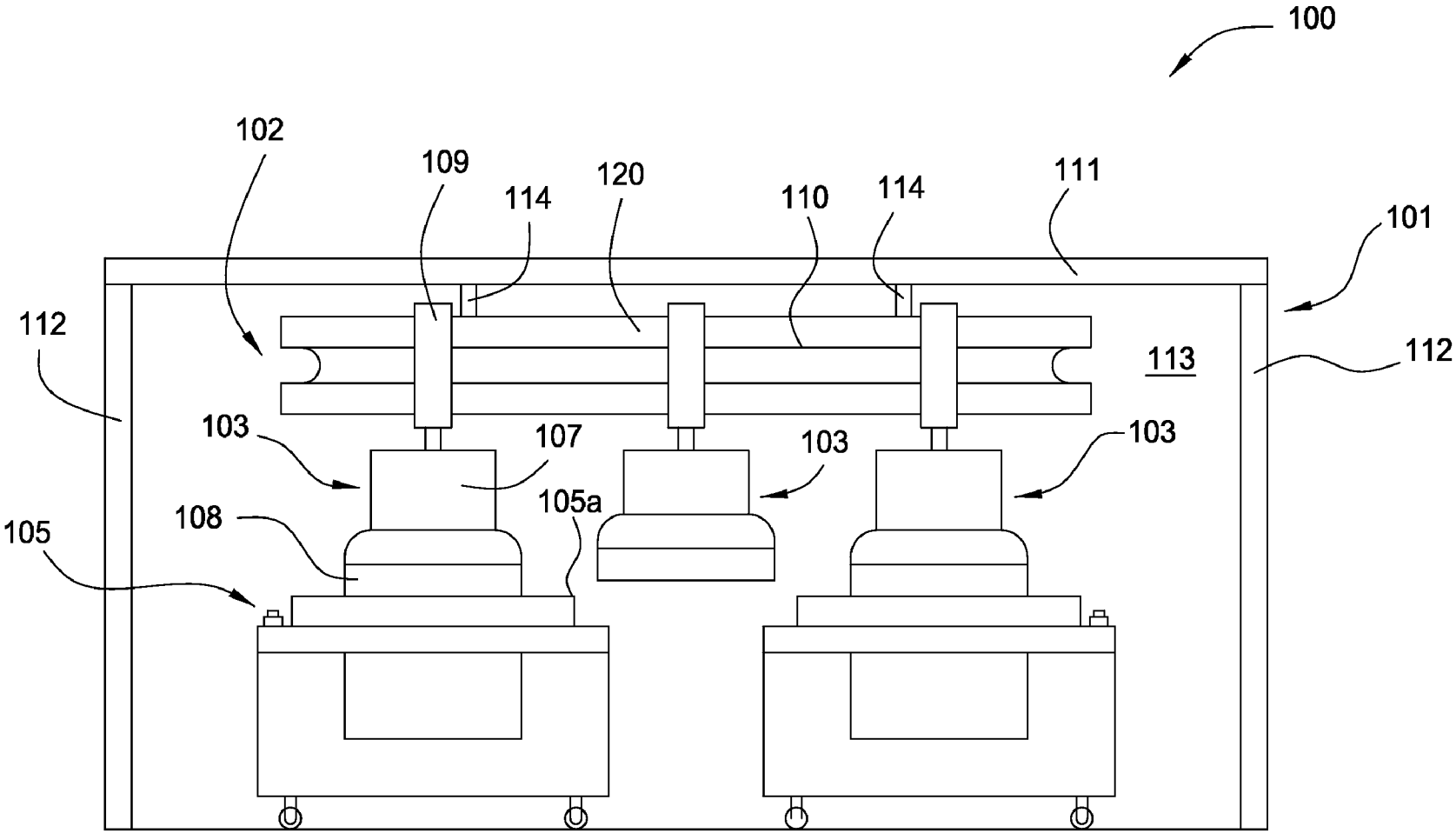
FIG. 1B is a schematic section view of the polishing system of FIG. 1A.

FIG. 1A is a schematic perspective view of a polishing system 100 in accordance with one embodiment of the present invention. FIG. 1B is a schematic section view of the polishing system 100 of FIG. 1A.

The polishing system 100 comprises a system frame 101 configured to provide support for apparatus using in a polishing process. A transferring mechanism 102 is coupled to the system frame 101. A plurality of polishing heads 103 are movably coupled to the transferring mechanism 102. Each of the plurality of polishing head 103 is configured to retain and transfer a substrate during polishing. The polishing system 100 further comprises two or more stand alone polishing stations 105. Each of the stand alone polishing station 105 is configured to receive the plurality of the polishing heads 103 and to process the substrates retained thereon. The transferring mechanism 102 is configured to move each of the plurality of polishing heads 103 independently and to align each of the plurality of polishing heads 103 with the two or more stand alone polishing stations 105 during processing. In one embodiment, the polishing system further comprises a loading assembly 104 configured to load and unload substrates to and from each of the plurality of polishing heads 103.

In one embodiment, the stand alone polishing stations 105 are modular processing stations and are structurally separated from the transferring mechanism 102 and the plurality of polishing heads 103. Therefore, the stand alone polishing stations 105, along with the loading assembly 104, can be arranged, rearranged, or maintained independently without affecting each other or the transferring mechanism and the plurality of polishing heads 103.

The system frame 101 is configured to provide structure support to the transferring mechanism 102 and the plurality of polishing heads 103. In one embodiment, the system frame 101 comprises a top frame 111 and four supporting columns 112 coupled to the top frame 111. The system frame 101 defines a processing volume 113 to retain the transferring mechanism 102, the plurality of polishing heads 103, the stand alone polishing stations 105, and the loading assembly 104. In one embodiment, the processing volume 113 can be enclosed and isolated from outside using doors movably coupled to the supporting columns 112.

In one embodiment, the transferring mechanism 102 coupled to the top frame 111 to position the plurality of polishing heads 103 in an upper portion of the processing volume 113. In one embodiment, the transferring mechanism 102 is suspended from the top frame 111 by connecting components 114.

In one embodiment, the transferring mechanism 102 comprises a track assembly 120 configured to move the plurality of polishing heads 103 along a path. The track assembly 120 comprises a track body 110 defining a path along which the polishing heads 103 may move. The track assembly 120 further comprises one or more carriages 109 movably connected to the track body 110. Each of the one or more carriages 109 is configured to carry at least one polishing heads 103.

The track assembly 120 defines a path to allow each of the polishing heads to access the polishing stations 105, the loading assembly 104, or any other processing stations needed for a processing recipe, such as cleaning stations. The path defined by the track assembly 120 may be linear, curved, close looped, circular, or with a shape of combinations thereof.

In one embodiment, the track assembly 120 comprises a stator strip defining the path along which the plurality of polishing heads 103 may be moved by interactions between a rotor coupled to each of the polishing heads and the stator strip. In one embodiment, the stator strip comprises a plurality of permanent magnets, the rotor is a segment motor, and each of the polishing heads 103 is moved or stopped by interaction between magnetic fields of the permanent magnets and magnetic fields generated by the segment motor from electronic power provided to the segment motor. In one embodiment, one or more guide rails are disposed along the path defined by the stator strip and each of the one or more polishing heads are coupled to the one or more guide rails by one or more sliding blocks.

Examples embodiments of the track assembly 120 can be found in U.S. Provisional Patent Application Ser. No. 61/043,582, filed Apr. 9, 2008, entitled "A Polishing System Having a Circular Track," and the U.S. Provisional Patent Application Ser. No. 61/047,943, filed Apr. 25, 2008, entitled "High Throughput Chemical Mechanical Polishing System", and U.S. patent application Ser. No. 12/420,996filed Apr. 9, 2009, entitled "Polishing System Having a Track".

In one embodiment, each of the plurality of polishing heads 103 comprises a polishing motor 107 mounted on one of the carriages 109, and a substrate carrier 108 connected to the polishing motor 107. The substrate carrier 108 is configured to secure a substrate during polishing. The polishing motor 107 is configured to rotate the substrate carrier 108, thus the substrate secured thereon, against a polishing surface 105*a* of the polishing station 105. Examples of a polishing head may be found in U.S. Pat. No. 6,183,354, entitled "Carrier Head with a Flexible Membrane for a Chemical Mechanical Polishing", and co-pending U.S. Pat. No. 7,001,257, entitled "Multi-chamber Carrier Head with a Flexible Membrane".

As shown in FIGS. 1A and 1B, two or more modular polishing stations 105 and the loading assembly 104 are disposed in a lower portion of the processing volume 113. The polishing stations 105 and the loading assembly 104 are structurally separated from the transferring mechanism 102 and the plurality of polishing heads 103. Each of the stand alone polishing stations 105 is configured to operate independently and to enable flexible combinations of polishing stations, loading stations or cleaning stations, for different processing recipes.

Figure 2:
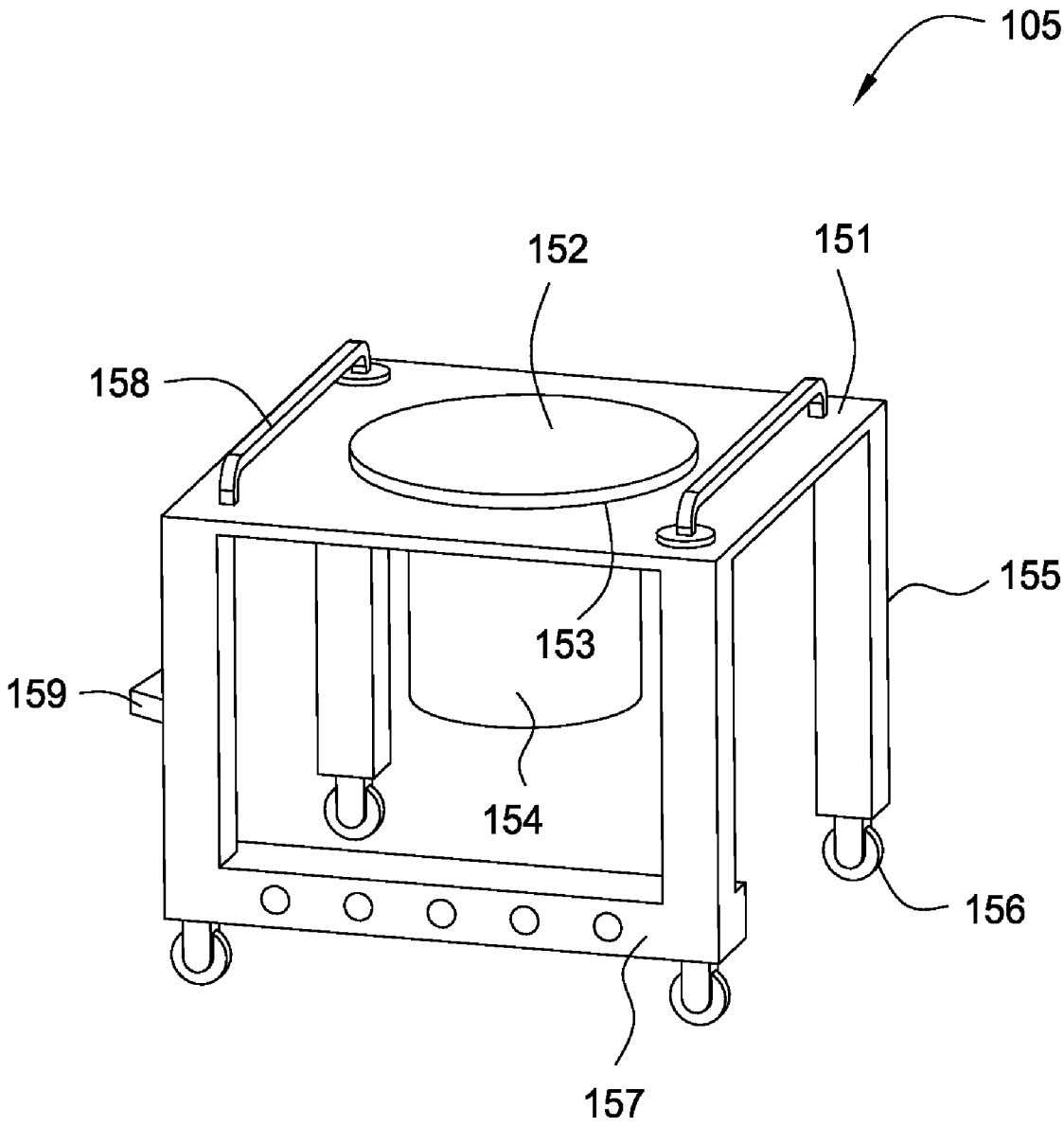
FIG. 2 is a schematic perspective view of a modular polishing system in accordance with one embodiment of the present invention.

FIG. 2 is a schematic perspective view of the stand alone polishing station 105 in accordance with one embodiment of the present invention. The stand alone polishing station 105 comprises a processing platform 151. The processing platform 151 is supported by a supporting frame 155. A platen 153 is disposed on the processing platform 151. The platen 153 is configured to support and rotate a polishing pad 152 thereon. The polishing pad 152 has a processing surface and is configured to polish a substrate using mechanical and/or chemical forces. In one embodiment, a platen motor 154 is disposed below the platen 153. A detailed description of a platen and a polishing pad may be found in co-pending U.S. patent application Ser. No. 10/880,752, filed on Jun. 30, 2004, published as United States Patent Publication 2005/0000801, entitled "Method and Apparatus for Electrochemical Mechanical Processing". A detailed description for the polishing pad may be found in co-pending U.S. patent application Ser. No. 10/455,895, filed on Jun. 6, 2003, published as United States Patent Publication 2004/0020789, entitled "Conductive Polishing Article for Electrochemical Mechanical Polishing".

In one embodiment, one or more conditioning stations 158 are disposed on the platform 151 and are configured to condition the polishing pad 152. A detailed description of a conditioning station can be found in the U.S. Pat. No. 7,210,981, entitled "Smart Conditioner Rinse Station".

In one embodiment, the stand alone polishing station 105 further comprises an interface assembly 157 coupled to the supporting frame 155. The interface assembly 157 is configured to provide interface for polishing solutions, cleaning solution, electric power supply, control signals. In one embodiment, the interface assembly 157 may be a standardized interface for quick and easy system assembly.

In one embodiment, the stand alone polishing station 105 comprises a moving mechanism 156 configured to allow easy movement of the polishing station 105. In one embodiment, the moving mechanism 156 may be casters coupled to the supporting frame 155. In one embodiment, the moving mechanism 156 can be locked to secure the polishing station 105 once arrangement is setup, and unlocked for adjustment, replacement or maintenance of the polishing station 105.

In one embodiment, the polishing station 105 comprises a locking mechanism 159 configured to secure the polishing station 105 during processing. In one embodiment, the locking mechanism 159 may comprise clamps to couple with the supporting column 112 of the polishing system 100, or with neighboring stand alone polishing stations 105, loading assemblies 104, or other modular devices.

Figure 3:
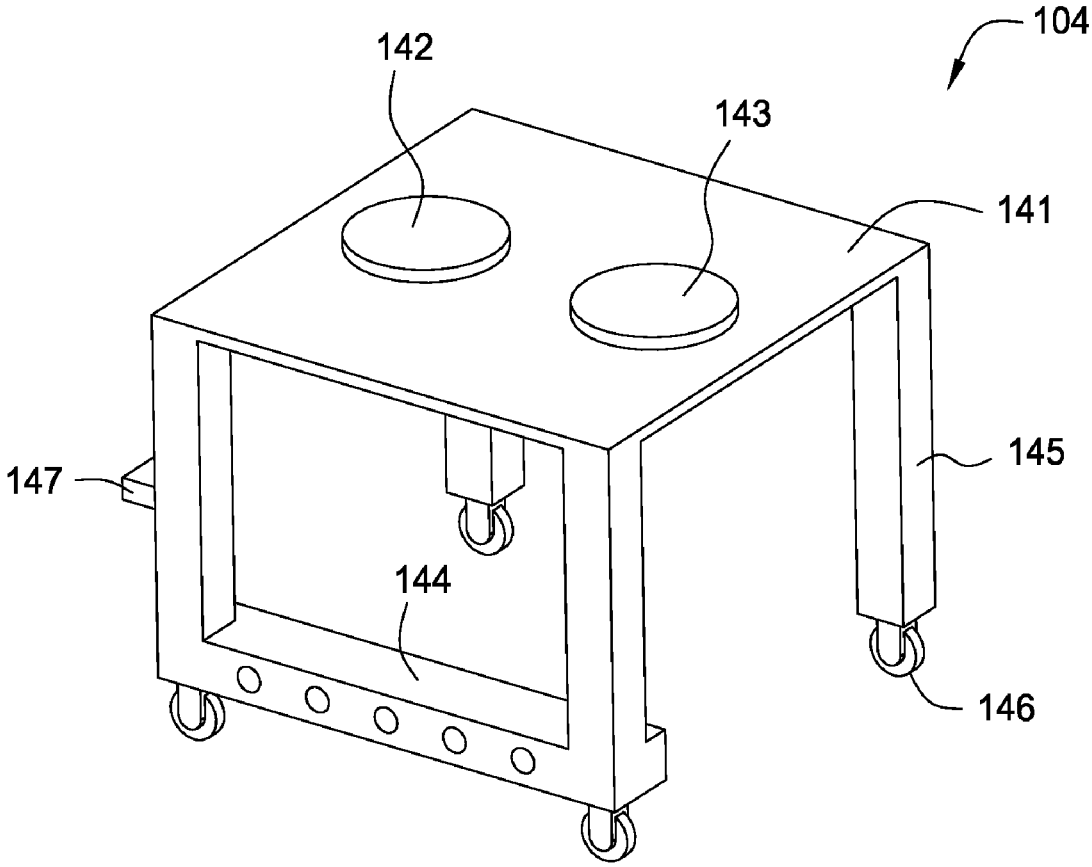
FIG. 3 is a schematic perspective view of a modular loading assembly in accordance with one embodiment of the present invention.

FIG. 3 is a schematic perspective view of the loading assembly 104 in accordance with one embodiment of the present invention. The loading assembly 104 comprises a processing platform 141. The processing platform 141 is supported by a supporting frame 145. Two load cups 142, 143 are disposed on the processing platform 141. The load cups 142, 143 are configured to interact with the polishing heads 103 to load and unload the substrate. The load cups 142, 143 may also serve as cleaning station configured to clean the polishing heads 103 and the substrate retained thereon. A detailed description of a load cup may be found in co-pending U.S. Pat. No. 7,044,832, entitled "Load Cup for Chemical Mechanical Polishing".

In one embodiment, the loading assembly 104 further comprises an interface assembly 144 coupled to the supporting frame 145. The interface assembly 144 is configured to provide interface for cleaning solution, electric power supply, and control signals. In one embodiment, the interface assembly 147 may be a standardized interface for quick and easy system assembly.

In one embodiment, the loading assembly comprises a moving mechanism 146 configured to allow easy movement of the loading assembly 104. In one embodiment, the moving mechanism 146 may be casters coupled to the supporting frame 145. In one embodiment, the moving mechanism 146 can be locked to secure the loading assembly 104 once arrangement is setup, and unlocked for adjustment, replacement or maintenance of the loading assembly 104.

In one embodiment, the loading assembly 104 comprises a locking mechanism 147 configured to secure the loading assembly 104 during processing. In one embodiment, the locking mechanism 147 may comprise clamps to couple with the supporting column 112 of the polishing system 100, or with neighboring stand alone polishing stations 105, loading assemblies 104, or other modular devices.

During a typical polishing process, one of the polishing heads 103 may be moved to the loading assembly which is positioned within the system frame 101 and accessible to each of the polishing heads 103. A substrate may be loaded onto the substrate carrier 108 of the polishing head 103. The polishing head 103 may then move along the transferring mechanism 102 by the carriage 109. The substrate loaded on the substrate carrier 108 is then move to a first of the one or more polishing stations 105. The substrate is then lowered to be in contact with the platen 106 of the polishing station 105. The polishing head 103 may then press the substrate against the polishing pad and rotate the substrate using the polishing motor 107 to generate relative motion for polishing. The platen is usually rotated during polishing. In one embodiment, the polishing head 103 may be oscillated about a position in the track assembly 120 providing a sweeping motion between the platen and the substrate to improve polishing uniformity.

After polishing is complete in the first polishing station 105, the polishing head 103 may raise the substrate from the polishing station 105 and transfer the substrate along the track assembly 120 to the next polishing station 105 configured for a second polishing step, such as buffing.

The polishing system 100 may be arranged according to a process recipe to have different arrangement of polishing stations, load cups, and cleaning stations.

Figure 4A:
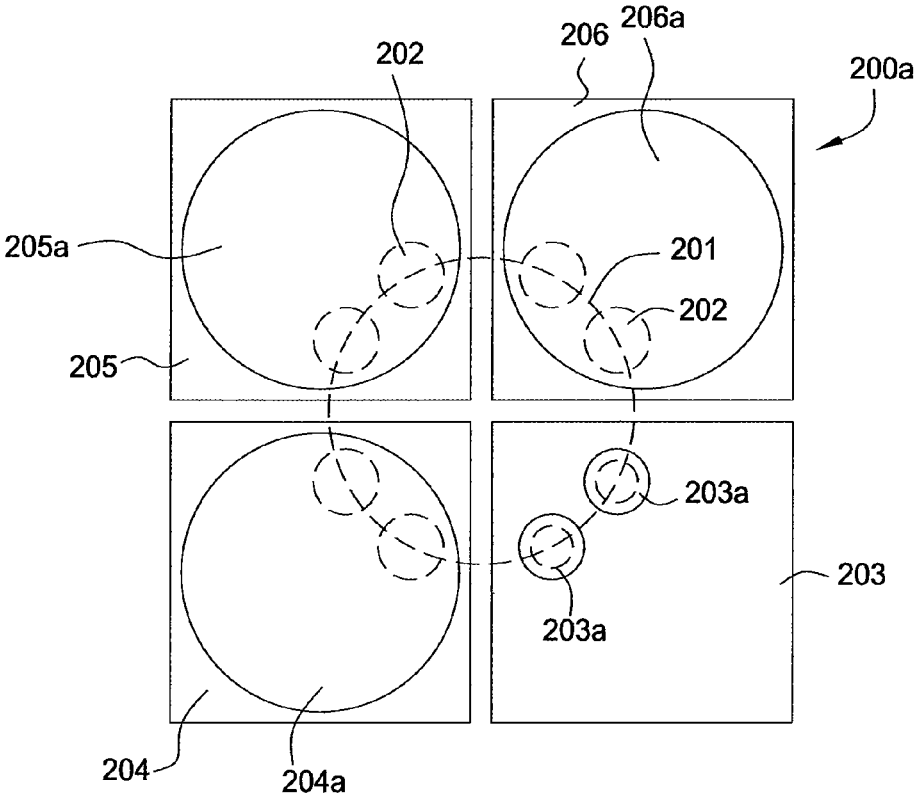
FIGS. 4A-4C are schematic top planar views of arrangements of polishing systems in accordance with embodiments of the present invention.
Figure 4B:
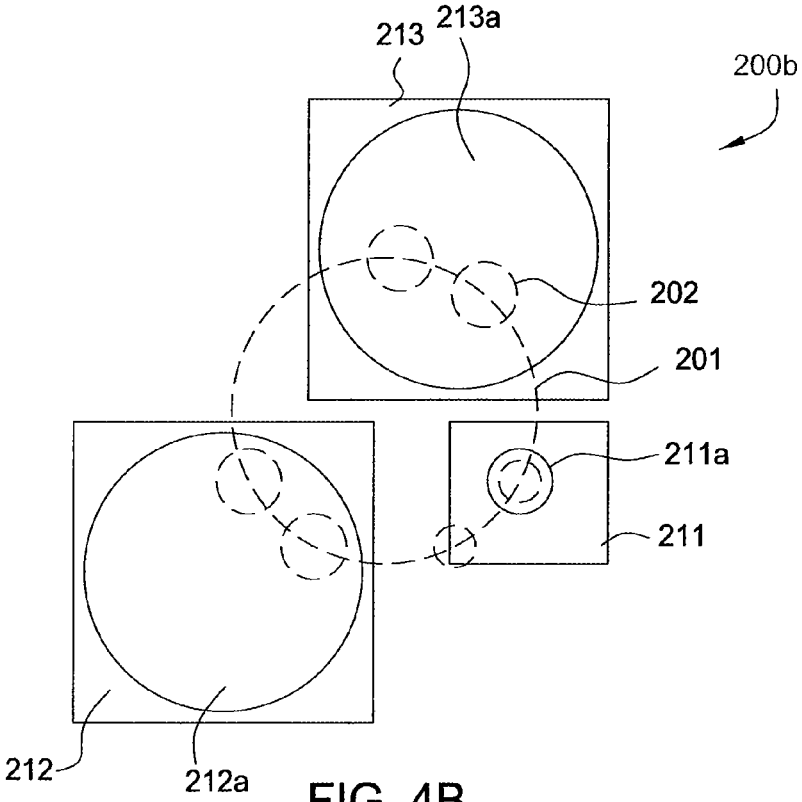
Figure 4C:
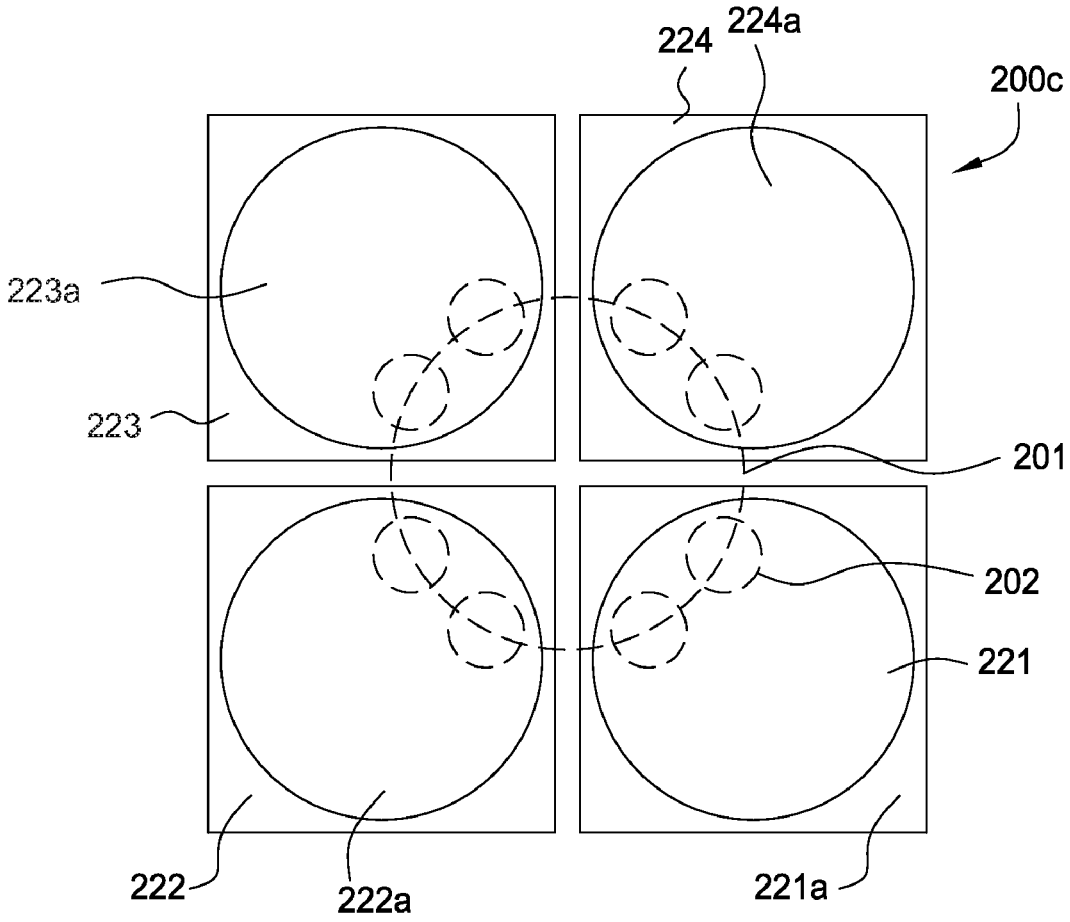

FIGS. 4A-4C are schematic top planar views of arrangements of polishing systems in accordance with embodiments of the present invention.

FIG. 4A schematically illustrates a polishing system **200*a* in accordance with one embodiment of the present invention. The polishing system 200*a* comprises a plurality of polishing heads 202 each independently movable along a circular track 201. The polishing system 200*b* also comprises one stand alone loading assembly 203 having two load cups 203*a*, and three stand alone polishing stations 204, 205, 206. The loading assembly 203, and the polishing stations 204, 205, 206 are disposed in an arrangement that each polishing pads 204*a*, 205*a*, 206*a* of the polishing stations 204, 205, 206 can receive two polishing heads 202 simultaneously while load cup 203*a* can align with one polishing head 202**.

In one embodiment, the polishing heads 202 are configured to retain one substrate having a diameter of about 12 inches and the polishing pads 204*a*, 205*a*, 206*a* may have a diameter of about 42 inches.

FIG. 4B schematically illustrates a polishing system 200*b* in accordance with one embodiment of the present invention. The polishing system 200*b* comprises a plurality of polishing heads 202 each independently movable along a circular track 201. The polishing system 200*b* also comprises one stand alone loading assembly 211 having one load cup 211*a*, and two stand alone polishing stations 212, 213. The loading assembly 211, and the polishing stations 212, 213 are disposed in an arrangement that each polishing pads 212*a*, 213*a* of the polishing stations 212, 213 can receive two polishing heads 202 simultaneously while the load cup 211*a* can align with one polishing head 202.

In one embodiment, the polishing heads 202 are configured to retain one substrate having a diameter of about 18 inches and the polishing pads 212*a*, 213*a* may have a diameter of about 52 inches.

FIG. 4C schematically illustrates a polishing system 200*c* in accordance with one embodiment of the present invention. The polishing system 200*c* comprises a plurality of polishing heads 202 each independently movable along a circular track 201. The polishing system 200*c* also comprises four stand alone polishing stations 221, 222, 223, 224. The polishing stations 221, 222, 223, 224 are disposed in an arrangement that each polishing pads 221*a*, 222*a*, 223*a*, 224*a* of the polishing stations 221, 222, 223, 224 can receive two polishing heads 202 simultaneously.

In one embodiment, the polishing heads 202 are configured to retain one substrate having a diameter of about 12 inches and the polishing pads 221, 222, 223, 224 may have a diameter of about 30 inches.

Even though a polishing process is described with the modular system of the present invention, a person skilled in the art can apply the track in any suitable processes that require movement of substrates between different workstations.

While the foregoing is directed to embodiments of the present invention, other and further embodiments of the invention may be devised without departing from the basic scope thereof, and the scope thereof is determined by the claims that follow.

What is claimed is:

1. A semiconductor substrate polishing system, comprising:

a frame defining a processing volume;

a plurality of polishing heads movably disposed in the processing volume, wherein each of the plurality of polishing heads is configured to retain and transfer a substrate during processing;

a transferring mechanism coupled to the frame, wherein the transferring mechanism is configured to move the plurality of polishing heads in the processing volume, the transferring mechanism comprises a track, and each of the plurality of polishing heads is attached to the track and independently movable along the track; and two or more stand alone movable polishing stations disposed in the processing volume, wherein each of the two or more stand alone polishing stations comprises a polishing pad positioned to receive and interact with each of the plurality of polishing heads, the track defines a path that allows each of the plurality of polishing heads to access each of the two or more stand alone polishing stations, and rearrangement of the two or more stand alone polishing stations does not affect the transferring mechanism and the plurality of polishing heads.

2. The semiconductor substrate polishing system of claim 1, wherein the track is circular.

3. The semiconductor substrate polishing system of claim 1, wherein the track is coupled to the frame and configured to move the plurality of polishing heads in an upper portion of the processing volume, and the two or more polishing stations are disposed in a lower portion of the polishing volume.

4. The semiconductor substrate polishing system of claim 1, further comprises a stand alone loading station disposed in the processing volume, and configured to load and unload substrates to and from each of the plurality of polishing heads.

5. The semiconductor substrate polishing system of claim 4, wherein the stand alone loading station comprises two load cups, and each of the two load cups is configured to interact with one of the plurality of polishing heads.

6. The semiconductor substrate polishing system of claim 4, wherein the stand alone loading station comprises casters configured allow easy relocation of the stand alone loading station.

7. The semiconductor substrate polishing system of claim 1, wherein each of the two or more stand alone polishing stations comprises:

a body;

a platen assembly disposed on the body, wherein the polishing pad is disposed on the platen;

an interface assembly disposed on the body, wherein the interface assembly is configured to connect the polishing station with a polishing solution source, a power source, and a controller; and casters coupled to the body and configured to allow easy movement of the polishing station.

8. The semiconductor substrate polishing system of claim 7, wherein each of the two or more stand alone polishing stations further comprises a latching mechanism configured to secure the stand alone polishing station relative to the supporting frame.

9. A semiconductor substrate polishing system, comprising:

a supporting frame;

a track assembly coupled to the supporting frame;

two or more polishing heads movably coupled to the track assembly, wherein the track assembly defines a path and the two or more polishing heads are independently movable along the path; and first and second stand alone movable polishing stations disposed along the path, wherein each of the first and second stand alone polishing stations is positioned to receive each of the two or more polishing heads and to process substrates retained by the two or more polishing heads, wherein rearrangement of the first and second stand alone, movable polishing stations does not affect the movement of the plurality of polishing heads.

10. The semiconductor substrate polishing system of claim 9, wherein the track assembly is circular and the two or more polishing heads are independently movable along a circular path.

11. The semiconductor substrate polishing system of claim 9, wherein each of the first and second stand alone polishing station comprises:

a body;

a platen assembly disposed on the body, wherein a polishing pad is disposed on the platen; and casters coupled to the body and configured to allow easy movement of the stand alone polishing station.

12. The semiconductor substrate polishing system of claim 11, wherein the polishing pad is configured to receive at least two or more polishing heads simultaneously.

13. The semiconductor substrate polishing system of claim 11, wherein each of the first and second stand alone polishing station further comprises a positioning mechanism configured to secure the position of the polishing station during processing.

14. The semiconductor substrate polishing system of claim 9, further comprising a load cup assembly disposed along the path and configured to receive the two or more polishing heads and to load and unload substrates to and from the two or more polishing heads.

15. The semiconductor substrate polishing system of claim 14, further comprising a third stand alone polishing station disposed along the path and configured to receive the two or more polishing heads.

* * * * *